US007346428B1

(12) United States Patent
Huffman et al.

(10) Patent No.: US 7,346,428 B1
(45) Date of Patent: Mar. 18, 2008

(54) ROBOTIC SWEEPER CLEANER WITH DUSTING PAD

(75) Inventors: Eric C. Huffman, Lowell, MI (US); Jonathon L. Miner, Rockford, MI (US)

(73) Assignee: Bissell Homecare, Inc., Grand Rapids, MI (US)

( * ) Notice: Subject to any disclaimer, the term of this patent is extended or adjusted under 35 U.S.C. 154(b) by 746 days.

(21) Appl. No.: 10/707,129

(22) Filed: Nov. 21, 2003

Related U.S. Application Data

(60) Provisional application No. 60/319,723, filed on Nov. 22, 2002.

(51) Int. Cl.
*G06F 19/00* (2006.01)

(52) U.S. Cl. ..... 700/245; 700/246; 700/248; 700/249; 700/250; 700/259; 318/568.1; 701/300; 701/301

(58) Field of Classification Search ..... 700/245, 700/246, 248, 249, 250, 259; 318/568.1; 701/300, 301
See application file for complete search history.

(56) References Cited

U.S. PATENT DOCUMENTS

| | | | | |
|---|---|---|---|---|
| 5,815,880 | A | 10/1998 | Nakanishi | |
| 5,959,423 | A | 9/1999 | Nakanishi et al. | |
| 5,995,844 | A | 11/1999 | Fukuda | |
| 6,459,955 | B1 | 10/2002 | Bartsch et al. | |
| 6,481,515 | B1 | 11/2002 | Kirkpatrick et al. | |
| 6,574,536 | B1 | 6/2003 | Kawagoe et al. | |
| 6,594,844 | B2 | 7/2003 | Jones | |
| 6,633,150 | B1 | 10/2003 | Wallach et al. | |
| 7,024,278 | B2 * | 4/2006 | Chiappetta et al. | 700/245 |
| 7,113,847 | B2 * | 9/2006 | Chmura et al. | 700/245 |
| 7,155,308 | B2 * | 12/2006 | Jones | 700/245 |
| 2002/0002751 | A1 | 1/2002 | Fisher | |
| 2003/0060928 | A1 | 3/2003 | Abramson et al. | |

* cited by examiner

*Primary Examiner*—Thomas Black
*Assistant Examiner*—Marc McDieunel
(74) *Attorney, Agent, or Firm*—McGarry Bair PC

(57) ABSTRACT

An autonomously movable home cleaning robot that incorporates a sweeper and dust bin as well as a dusting assembly in tandem in the direction of movement of the robot.

12 Claims, 8 Drawing Sheets

ROBOTIC SWEEPER CLEANER WITH DUSTING PAD

CROSS REFERENCE TO RELATED APPLICATIONS

This application claims the benefit of U.S. Provisional Application Ser. No. 60/319,723, filed Nov. 22, 2002.

BACKGROUND OF INVENTION

A home cleaning robot comprising a platform in combination with a cleaning implement, for example a non-woven electrostatic cloth, and a motive force to autonomously move the platform is disclosed in U.S. Pat. No. 6,459,955 to Bartsch et al. The robot moves randomly about a surface while cleaning the surface with the cloth. U.S. Pat. No. 6,481,515 to Kirkpatrick et al. discloses a similar device with a surface treating sheet and also includes a chamber for storing fluid that is applied to the surface through the surface treating sheet. Another robotic floor cleaner disclosed in U.S. Patent Application Publication No. 2002/0002751 to Fisher utilizes disposable cleaning sheets, such as dust cloths, retained by several sheet holder receptacles on a compliant pad. The robotic floor cleaner further comprises an appendage that can have several functions, including a sheet holder or a fluid dispenser. U.S. Pat. No. 6,633,150 to Wallach et al. discloses a mobile robot that mops a surface by pressing a damp towel, which is mounted to the body of the robot, against the ground as the robot moves back and forth. One limitation of these types of robot cleaners is that large debris is pushed in front of the robot without being picked up. Another limitation is that the large debris tends to clog or bind the cloth, thus reducing the useful life of the cloth.

Some automatic robots that vacuum or sweep floors and other surfaces are capable of removing large debris. For example, an automatic robotic vacuum cleaner integrating a drive system, a sensing systems, and a control system with a microprocessor is disclosed in U.S. Patent Application Publication No. 2003/0060928. Examples of commercially available robotic vacuum cleaners include the Roomba vacuum cleaner from iRobot, the Karcher Robo-Vac vacuum cleaner, the Robo Vac vacuum cleaner from Eureka, the Electrolux Trilobite vacuum cleaner, and the LG Electronics Robot King vacuum cleaner. The aforementioned U.S. Pat. No. 6,633,150 to Wallach et al. further discloses a mobile robot vehicle with a motor-driven brush that sweeps debris from the floor and into a dustpan positioned close to the brush as the vehicle moves forward and backward. Additionally, U.S. Pat. No. 6,594,844 to Jones discloses an obstacle detection system for a robot configured to dust, mop, vacuum, and/or sweep a surface such as a floor. U.S. Pat. No. 5,815,880 to Nakanishi and U.S. Pat. No. 5,959,423 to Nakanishi et al. disclose similar mobile work robots that comprise a dust collecting unit for vacuuming or suctioning dust from the floor and a wiping unit for spreading fluid, such as detergent, disinfectant, or wax, onto the floor and wiping the floor. Furthermore, a wireless mobile vehicle described in U.S. Pat. No. 5,995,884 to Allen et al. comprises a vacuum system that can be adapted to make the vehicle suitable for a damp-mopping function by including a rotating mop head and reservoirs for clean and dirty water.

SUMMARY OF INVENTION

According to the invention, an autonomously movable home cleaning robot comprises a base housing; a drive system mounted to the base housing whereby the drive system is adapted to autonomously move the base housing on a substantially horizontal surface having boundaries; a computer processing unit associated with the base housing for storing, receiving and transmitting data; a rotary driven brush mounted for rotation in a sweeper aperture for removing debris particles from the surface; a dust bin in communication with the sweeper aperture for receiving the debris particles removed from the surface; a power source connected to the drive system and computer processing unit whereby the computer processing unit controls horizontal movement of the base housing based upon input data defining said boundaries and a dusting assembly mounted to an underside of the base housing for removing dust from the surface to be cleaned.

In a preferred embodiment, the cleaning robot comprises a dusting cloth removably mounted to a dusting pad that is moveable away from the base housing for service of the dusting cloth. In another embodiment, the dusting pad is removably mounted to the base housing. In yet another embodiment, the dusting pad is hinged to the base housing for selectively pivoting the dusting pad between a first, opened position away from the underside of the base housing for removal and mounting of the dusting cloth to the dusting pad and a second, closed position in an operative position with the base housing. In yet another embodiment, the dusting pad comprises at least one dusting cloth engagement member mounted to an upper surface of the dusting pad for retaining a first portion of the dusting cloth. In still another embodiment, the pad is a resilient pad.

In a preferred embodiment, the cleaning robot comprises a dust bin that is removably mounted to the base housing. In one embodiment, the dust bin is removable from the bottom of the base housing. In another embodiment, the dust bin is removed from the top of the base housing. The sweeper assembly is typically mounted to the base housing forwardly, i.e., in the direction of movement of the base housing, of the dusting assembly.

DETAILED DESCRIPTION

Figure 1:
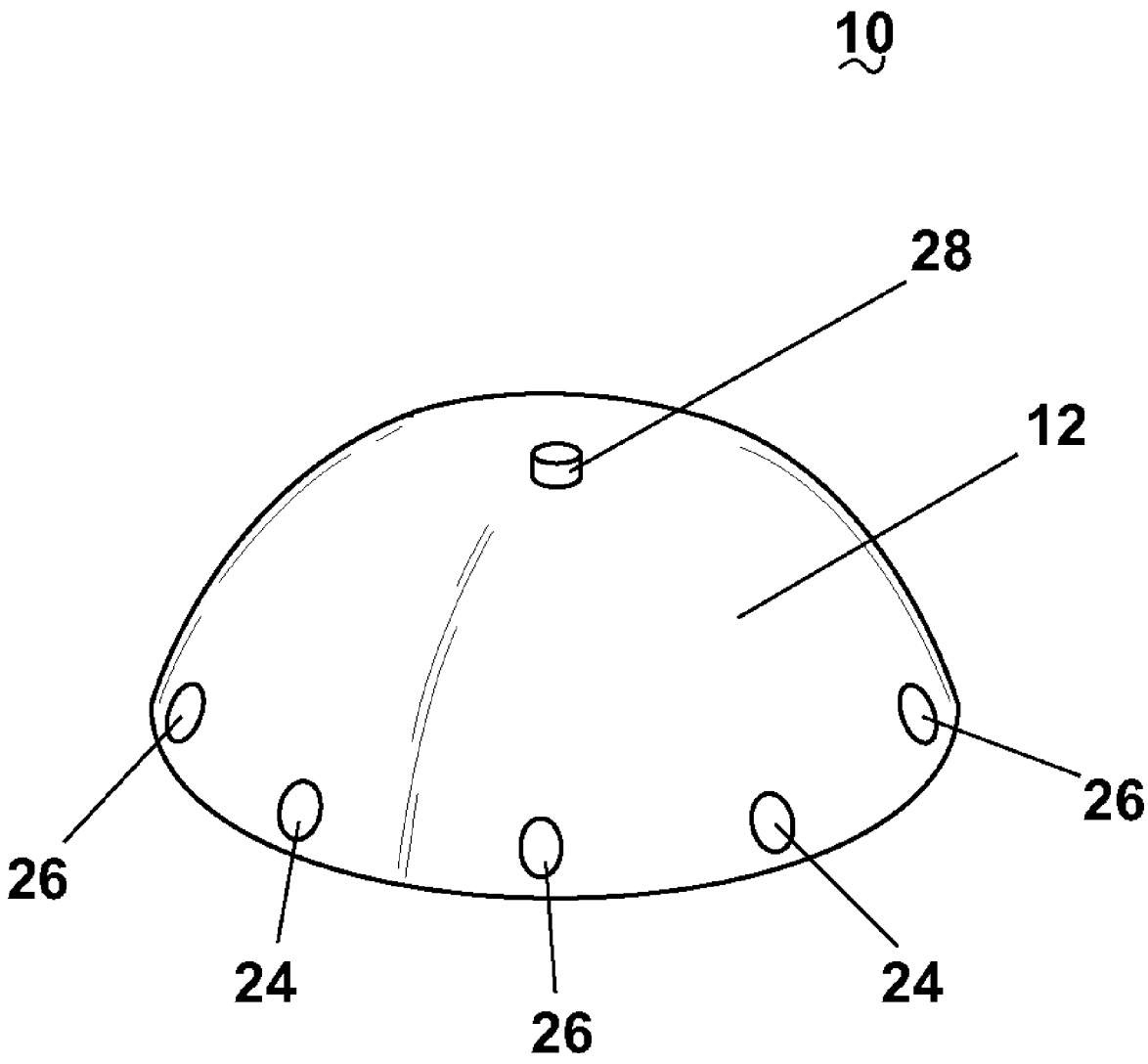
FIG. 1 is a perspective view of the robotic sweeper cleaner with dusting pad according to the invention.
Figure 2:
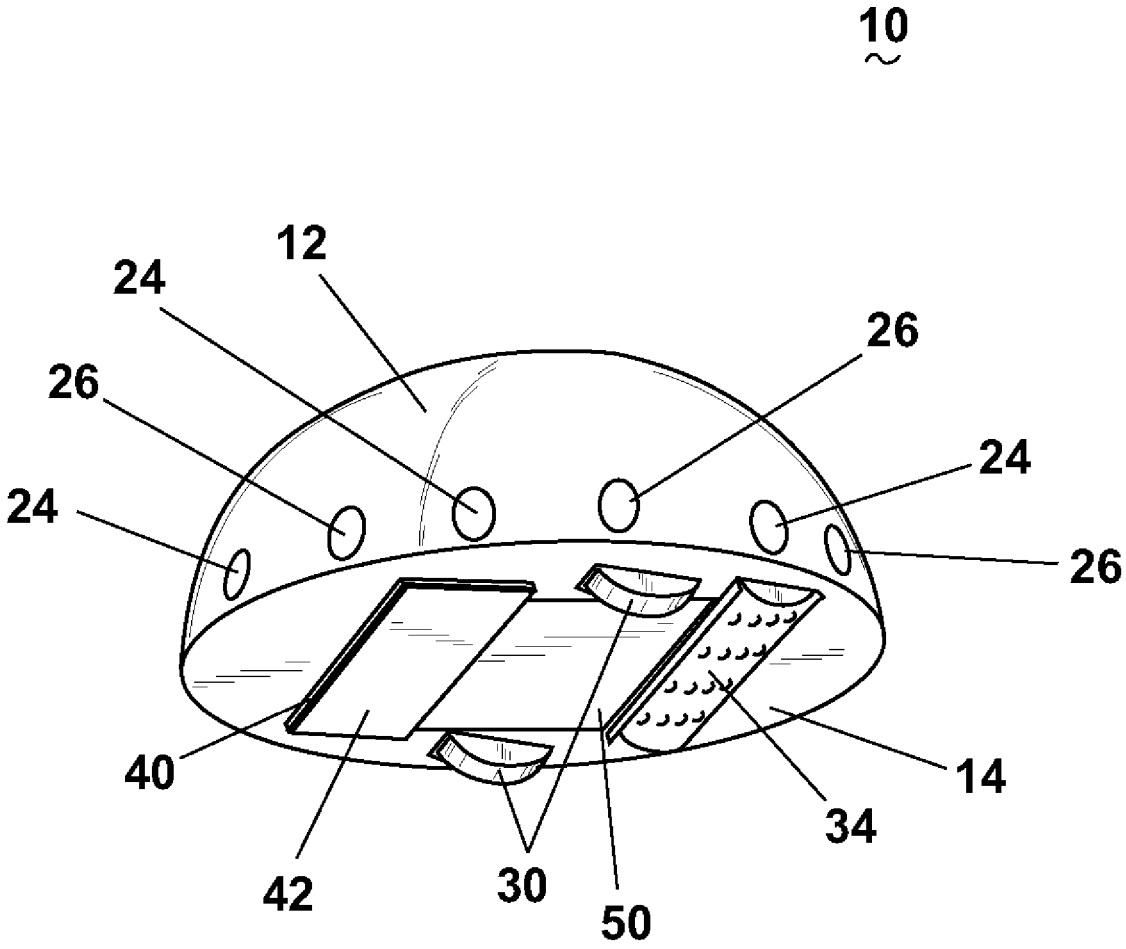
FIG. 2 is a perspective bottom view of the robotic sweeper cleaner with dusting pad in the operating position as shown in FIG. 1.
Figure 3:
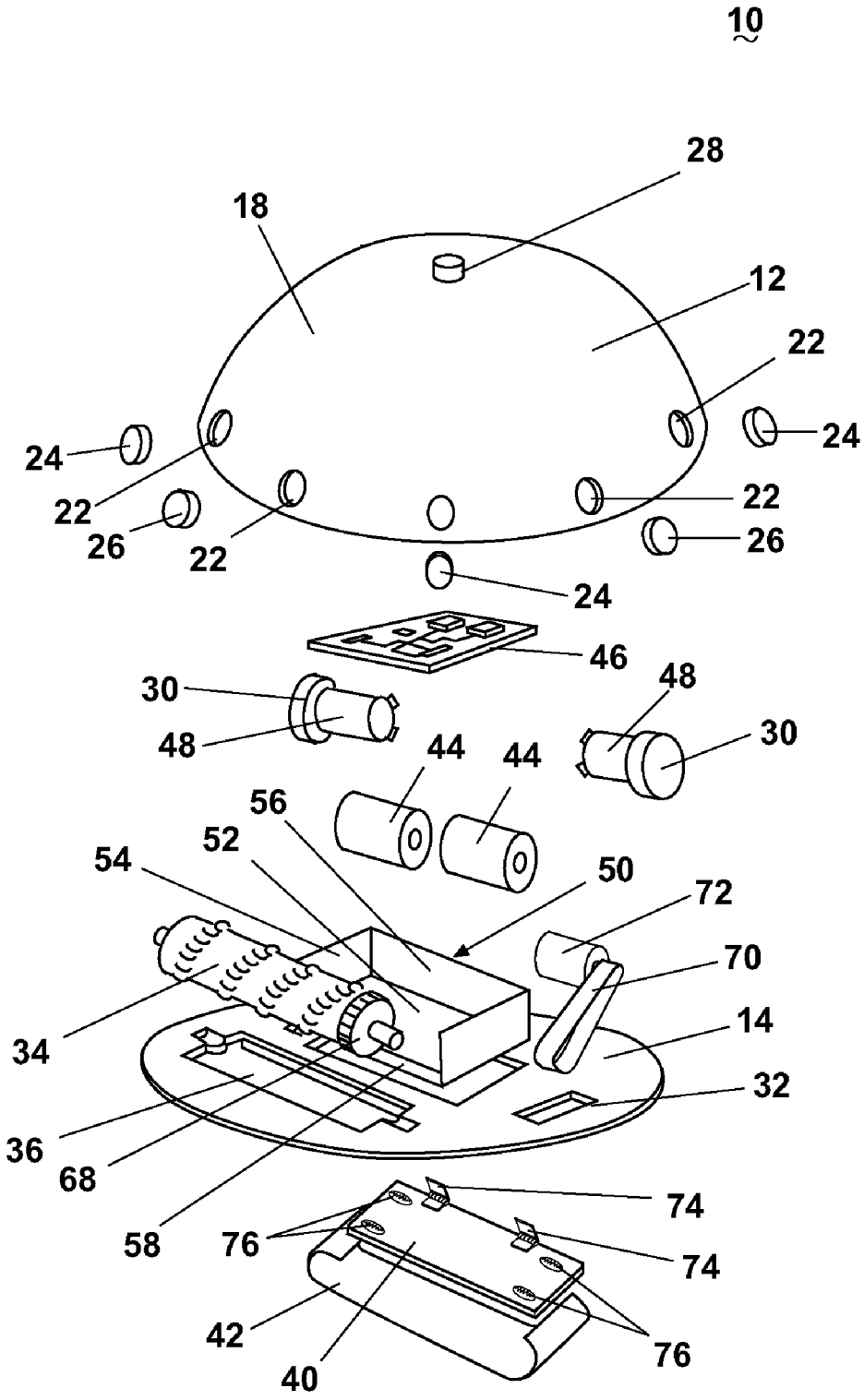
FIG. 3 is an exploded view of the robotic extraction sweeper with dusting pad shown in FIG. 1.

Referring to FIGS. 1-3, a robotic sweeper cleaner with dusting pad 10 is described and comprises robotic platform further comprising a top enclosure 12 and a base housing 14.

The base housing 14 provides the basic structure for the robotic platform on which all other components depend for structural support. A plurality of proximity sensors 24, 26 are located within corresponding sensor apertures 22 around the outer periphery of the top enclosure 12. The proximity sensors 24, 26 comprise any one or combination of commonly known sensors including infrared sensors 24, pressure sensitive sensors 26, or ultrasonic sensors affixed to the top enclosure 12 in alternating or parallel fashion. Alternating the arrangement of proximity sensors 24, 26 provides redundancy and allows for improved motion control of the robotic platform as it encounters obstacles within the room being cleaned. An electrical power switch 28 is located on a top surface of the top enclosure 12 and controls the flow of power from one or more batteries 44 to a logic board 46, both mounted to the base housing 14 within a cavity formed by the top enclosure 12.

Alternatively, or in combination with the proximity sensors 24, 26, a predetermined path is programmed in to the central processing unit by the user. In yet another embodiment, the path is dictated to the central processing unit via a remote control device.

Referring to FIGS. 2 and 3, a drive system comprises a pair of drive wheels 30 protrude through corresponding drive wheel apertures 32 which are located in spaced relation near the outer perimeter of the base 14. A brush roll 34 protrudes through a corresponding sweeper aperture 36 forming a forward portion of the base 14. A dusting pad 40 is attached to a bottom surface of the base 14 behind and in spaced relation to the brush roll 34 and the drive wheels 30. The dusting pad 40 is preferably hinged to a bottom surface of the base 14, however other commonly known fastening methods such as detents, latches, screws, snaps or hook and loop fasteners can also be used to secure the dusting pad 40 to the base 14. The dusting pad 40 and brush roll 34 are positioned in a generally parallel fashion with respect to the drive wheels 30. A removable dusting cloth 42 wraps around, and is held by, the dusting pad 40 as will be described further herein. The dusting assembly is disclosed in more detail in commonly owned U.S. patent application Ser. No. 10/248,101, filed Dec. 18, 2002, which disclosure is incorporated herein by reference.

Referring again to FIG. 3, a power source comprising a plurality of batteries 44, which may be any commonly known battery source including alkaline, rechargeable nickel-cadmium, NiMH, or LiMH are located on base assembly 14. When rechargeable batteries are used, a commonly known recharging circuit is used to transform available facility voltage to a level usable for the batteries 44. A charging plug connected to the transformer is manually or automatically attached to a corresponding jack connected to the batteries thereby completing the circuit and allowing the batteries to charge. A commonly known computer processing unit further comprising a logic board 46 is located between the base 14 and the top enclosure 12. The logic board 46 comprises a commonly known printed circuit board upon which commonly known computer processing and electronic components are mounted configured in a manner similar to that described by U.S. Pat. No. 6,459,955 to Bartsch et al. which is incorporated by reference herein in its entirety. Power from the batteries 44 is controlled by the switch 28. When switch 28 is on, power flows to the logic board 46. When the switch 28 is off, no power flows to the logic board 46. The logic board 46 receives inputs from the various sensors 24, 26, 38 and provides conditioned output to drive the drive wheels 30 and regulate a brush drive source. One example of such a logic board is that used in the commercially available TALRIK II robot manufactured by Mekatronix which is incorporated herein by reference.

Referring to FIG. 3, a drive system further comprising a plurality of reversible direct current (DC) drive motors 48 are preferably mounted on an upper surface of the base 14 perpendicular to each of the drive apertures 32. Alternatively, the drive motors 48 may be mounted on the lower surface of the base 14 or on a separate suspension plate (not shown). The drive motors 48 are directly coupled to the center of each drive wheel 30 such that rotation of the motor results in a corresponding rotation of the drive wheel 30. Energy to power the drive motors 48 is delivered from the logic board 46 to the drive motors 48 via commonly known wiring (not shown).

Figure 4:
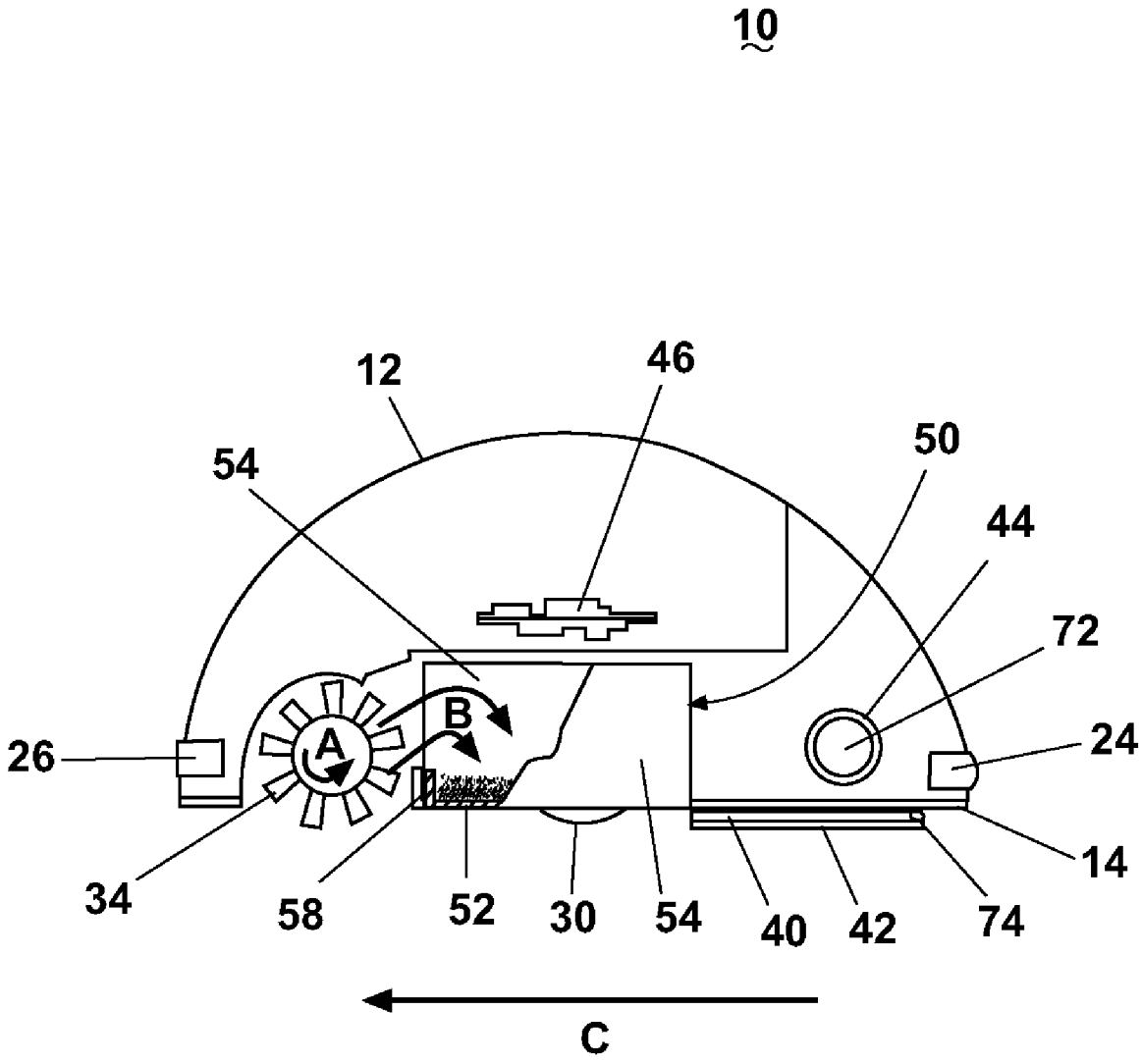
FIG. 4 is a partial cross-sectional side view of the base housing taken across line 4-4 of FIG. 1.

Referring to FIGS. 3 and 4, a dust bin 50 is removably mounted to the base housing 14 within a centrally located aperture as more fully described in U.S. Pat. No. 4,369,539 to Nordeen which is hereby incorporated by reference in its entirety. The dust bin 50 further comprises a bottom pan 52, two side walls 54, a rear wall 56, and a forward lip 58. In an alternate embodiment, the dust bin is rotated to an open position to allow for disposal of contained debris.

Referring to FIGS. 2, 3 and 4, an agitation system is described comprising at least one brush roll 34, a brush roll gear 68, a belt 70, and a brush drive source. The brush roll 34 is mounted horizontally within, and protrudes below the sweeper aperture 36 formed in the base 14. The brush roll 34 resides in a cavity formed within the sweeper aperture 36. The brush roll 34 is preferably a cylindrical dowel with flexible bristles protruding therefrom. Alternatively, the brush roll 34 comprises a plurality of pliable paddles in combination with, or separate from the bristles. An axle runs longitudinally through the center axis of the brush roll 34. In another embodiment, pair of counter-rotating brush rolls 34 are used in place of the single brush roll 34. Alternatively, the brush rolls 34 may rotate in the same direction. The brush roll gear 68 is fixedly attached to one of the axles. The axles rotate within commonly known bearings located on both sides of the sweeper aperture 36. A belt 70 engages the brush roll gear 68 on one end and is attached to a drive gear on the other. This commonly known agitation system is also described in U.S. Pat. No. 6,467,122 to Lenkiewicz which is incorporated herein by reference in its entirety. In another embodiment, brush drive is accomplished via the drive wheel motor 48 through a secondary gear attached to a protruding shaft. In the preferred embodiment, brush drive is provided by an electric brush motor 72. Power to the brush motor 72 is supplied by outputs from the logic board 46. The brush motor 72 is suitably mounted on an upper surface of the base 14 in such a manner that the drive gear on the brush motor 72 is in alignment with the brush roll gear 68.

Figure 5:
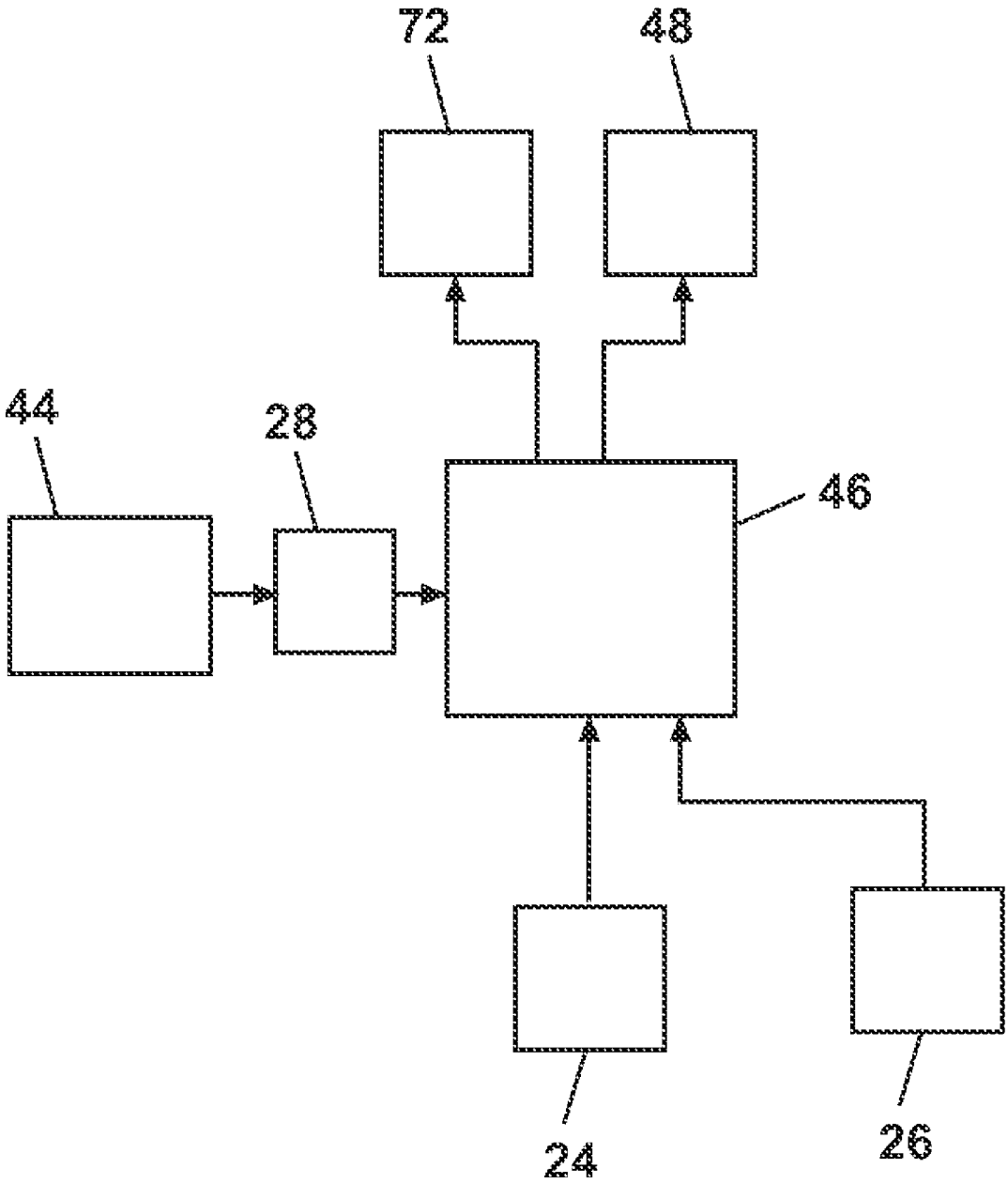
FIG. 5 is a schematic block diagram of the robotic sweeper cleaner with dusting pad as shown in FIG. 1.
Figure 6:
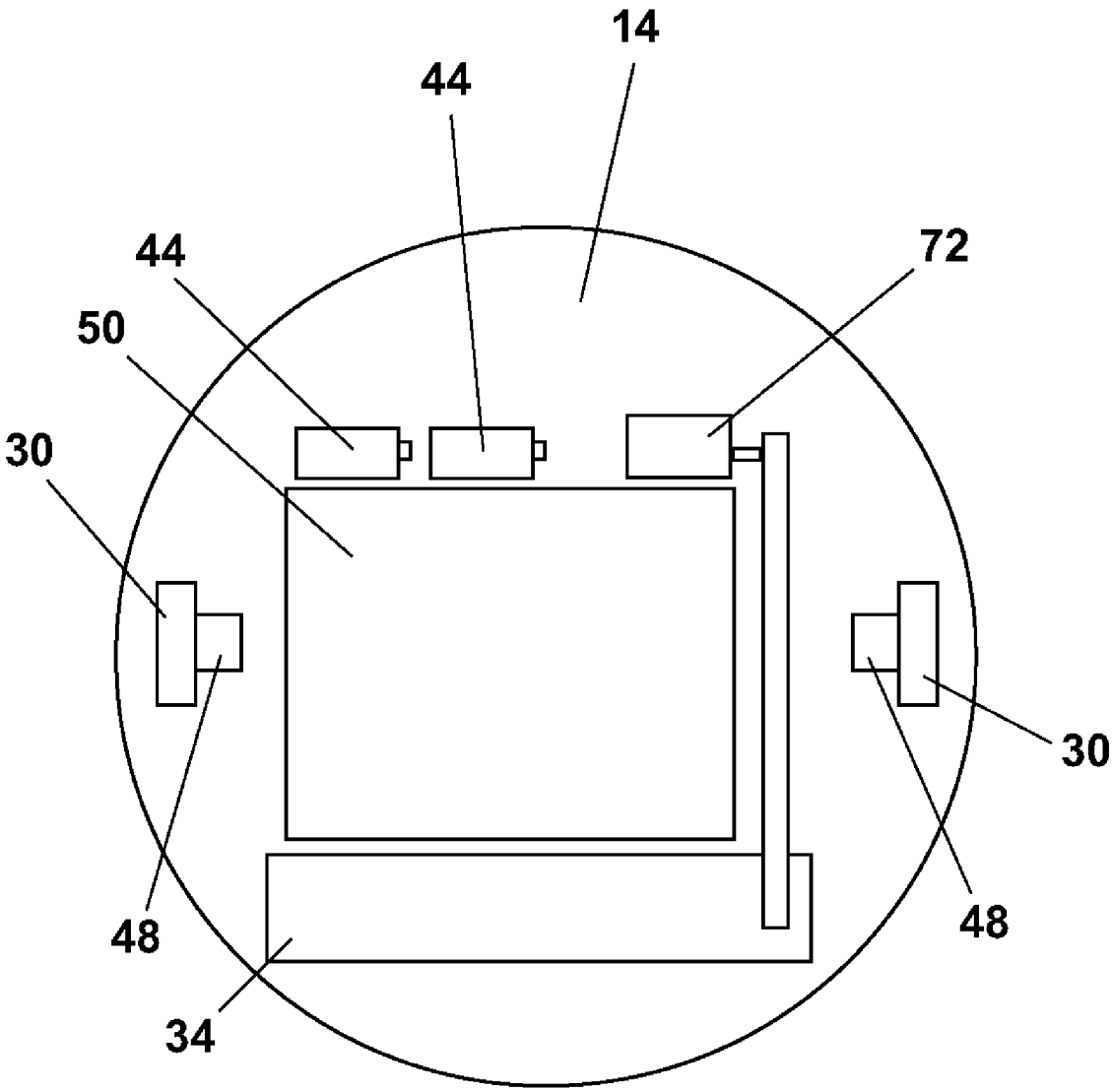
FIG. 6 is a plan view of the robotic sweeper cleaner with dusting pad as shown in FIG. 1.

The various components work together to control the robotic sweeper cleaner 10 as depicted schematically in FIG. 5 and shown in plan view in FIG. 6. Power is supplied to the logic board 46 through the batteries 44 via the power switch 28. The proximity sensors 24, 26 and provide inputs to the logic board 46. The logic board 46 processes the inputs and selectively sends appropriate output signals to the drive wheels 30.

The infra-red proximity sensors 24 emit an infra-red light beam that is reflected from surrounding objects and detected by the sensor 24. The pressure-sensitive proximity sensors 26 are activated by direct contact with a stationary object, closing a conductive path within the sensor 26 and providing a signal to the logic board 46. When activated, the robot sweeper cleaner 10 normally moves in a generally straight and forward direction because equal outputs are provided to each drive motor 48. Output signals to the individual drive motors 48 change as inputs from the various sensors change. For example, when one or more of the proximity sensors 24, 26 detect a stationary object, output to a corresponding drive wheel 30 is slowed. Since the drive wheels 30 are now moving at different speeds, the robot sweeper turns in the direction of the slower turning wheel.

Figure 7:
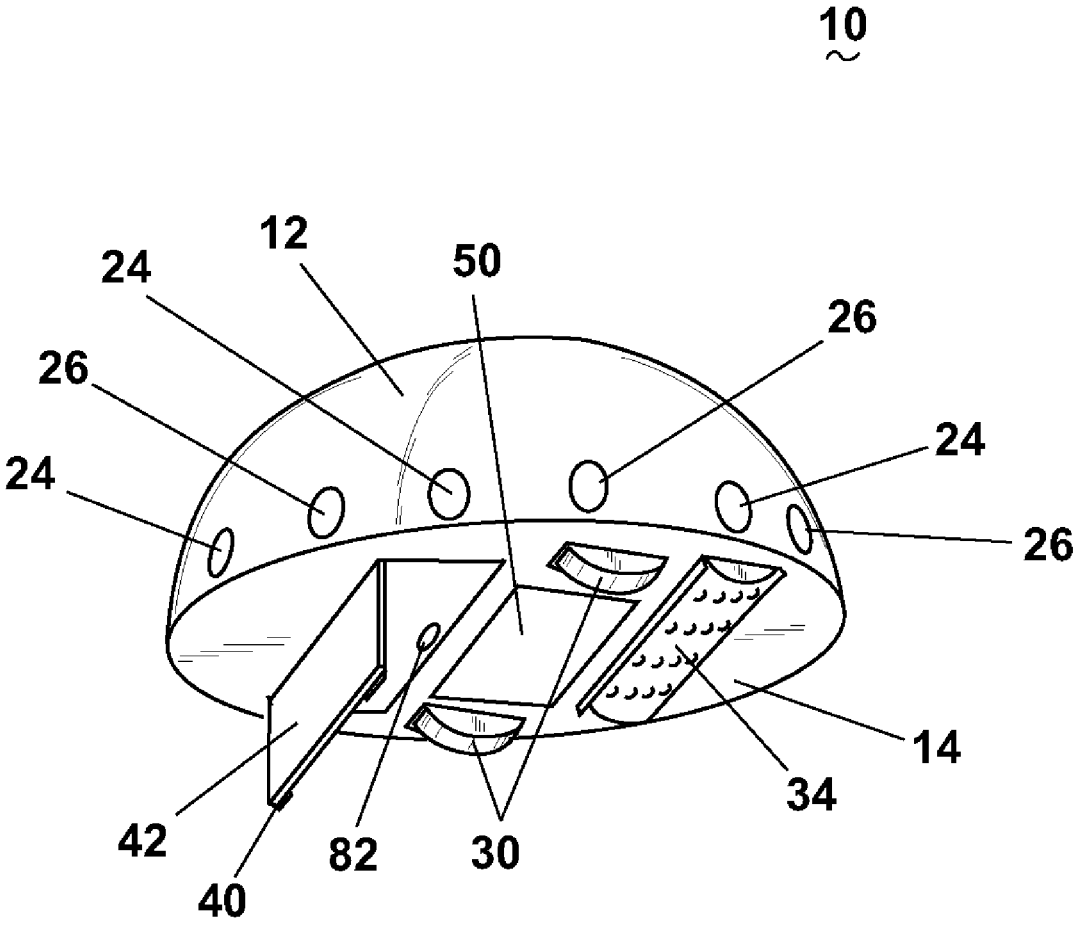
FIG. 7 is a perspective bottom view of the robotic sweeper cleaner with dusting pad in open position as shown in FIG. 1.
Figure 8:
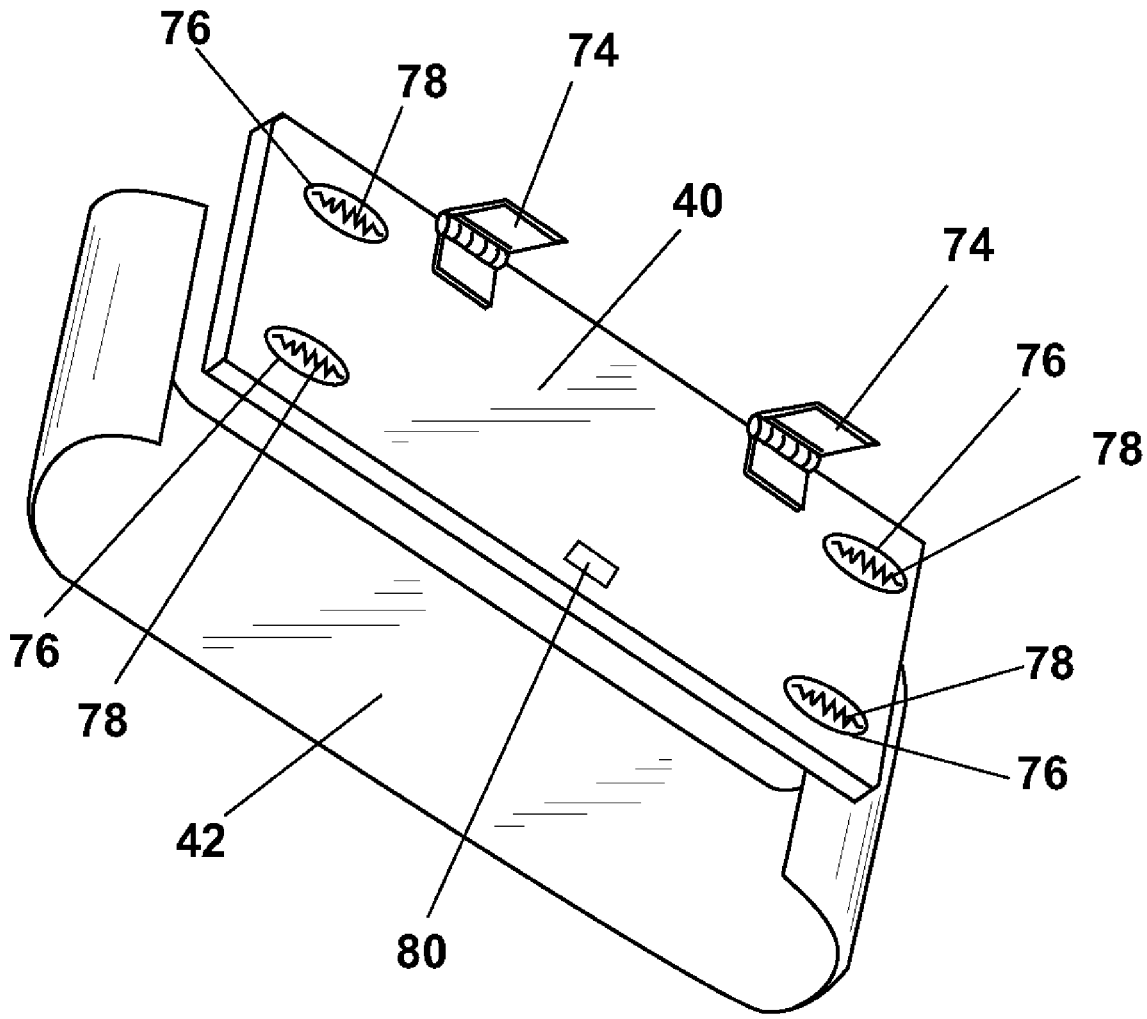
FIG. 8 is a perspective bottom view of the dusting pad of the robotic sweeper cleaner with dusting pad as shown in FIG. 1.

Referring to FIGS. 2, 7, and 8, a dusting assembly is described comprising a dusting pad 40, a dusting cloth 42, and a plurality of hinges 74. The dusting pad 40 further comprises a plurality of engagement members 76 that rest along the bottom surface of the base 14. The cloth engagement members 76 are made from a resilient material including any number of commonly known plastics and further comprise a plurality of slots 78. The cloth engagement members 76 are similar to those disclosed in U.S. Pat. No. 6,305,046 to Kingry, specifically in FIGS. 4 through 7, which is hereby incorporated by reference herein in its entirety.

The dusting pad 40 is attached to the base 14 via the plurality of hinges 74 affixed along a length of one side of the dusting pad 40 and at the rear of the base 14 on the other. A commonly known magnetic latch 80 is affixed to a top surface of the dusting pad 40. A steel catch 82 is located on the underside of the base 14 such that the catch 82 aligns with the latch 80 when the dusting pad 40 is placed in the closed position as defined by the upper surface of the dusting pad 40 being in direct contact with the lower surface of the base 14. Magnetic force between the latch 80 and the catch 82 maintains contact between the top of the dusting pad 40 and the bottom of the base 14 during use. To open the dusting pad 40, the user applies hand force to overcome the magnetic force, allowing the dusting pad 40 to rotate about the hinges 74 which then allows access to the engagement members 76. Alternatively, the dusting pad 40 is fixedly attached to the bottom surface of the base 14. The cloth engagement members 76 are accessible from the bottom and the dusting cloth 42 is removed directly from the bottom.

The dusting cloth 42 is wrapped around the dusting pad 40 in a longitudinal direction. In the preferred embodiment, the dusting cloth 42 is an electrostatically charged dry cloth that attracts oppositely charged debris particles. In an alternate embodiment, the dusting cloth 42 is a pre-moistened cloth suitable for removing sticky stains. The dusting cloth 42 is attached to the pad 40 by forcing the cloth 42 into the slots 78, thus providing an easy method of inserting and removing the dusting cloth 42 from the unit as disclosed in FIG. 2 of U.S. Pat. No. 6,305,046 to Kingry.

In operation, the user connects the robot sweeper cleaner 10 to facility power to energize the charging circuit. Once a full charge on the batteries 44 is achieved, the user removes the charging circuit from the robot sweeper cleaner 10 and engages the electrical switch 28. Power is then delivered to the logic board 46. The logic board 46 controls output based on input from the proximity sensors 24, 26. The robot sweeper cleaner 10 moves across the surface to be cleaned in a random fashion, changing speed and direction as the proximity sensors 24, 26 encounter. The logic board 46 directs the robot sweeper cleaner 10 to move in a direction that prefers the brush roll 34 in a forward position and the dusting cloth 42 in a rearward position. As such, larger loose debris is removed from the surface before the dusting cloth 42 passes. This sequence allows for longer life of the dusting cloth 42 and improved cleaning of the surface. After use, the user turns the electrical switch 28 to the off position, thus interrupting power to the logic board 46. The user removes the dust bin 50 from the top enclosure 12. Debris from the dust bin 50 is dumped into an appropriate disposal receptacle. The now dirty dusting cloth 42 is removed from the dusting pad 40 by overcoming the magnetic latch 80, rotating the dusting pad 40 to the open position, removing the dusting cloth 42, and similarly properly disposing of the dusting cloth 42. A new dusting cloth 42 is attached. The dust bin 50 is reattached to the top enclosure 12. The robot sweeper cleaner 10 is reattached to the charging circuit to replenish power to the batteries 44, whereby the entire cleaning process may begin again.

While the invention has been specifically described in connection with certain specific embodiments, it is to be understood that this is by way of illustration and not of limitation. Reasonable variation and modification are possible within the foregoing disclosure and drawings without departing from the spirit of the invention which is embodied in the appended claims.

What is claimed is:

1. An autonomously movable home cleaning robot comprising:

a base housing;

a drive system mounted to said base housing, said drive system adapted to autonomously move said base housing on a substantially horizontal surface having boundaries;

a computer processing unit for storing, receiving and transmitting data, said computer processing unit associated with said base housing;

a sweeper aperture and a rotary driven brush mounted for rotation in the sweeper aperture for removing debris particles from the surface;

a dust bin in close communication with the sweeper aperture for receiving the debris particles removed from the surface and moved into the dust bin by the brush;

a power source connected to said drive system and said computer processing unit whereby said computer processing unit directs horizontal movement of said base housing in a predetermined direction within the boundaries of the surface to be cleaned based upon input data defining said boundaries; and a dusting assembly for removing dust from the surface to be cleaned and mounted to an underside of the base housing in a rearward position relative to the sweeper aperture with respect to the predetermined direction for removing dust not removed from the surface to be cleaned by the brush.

2. An autonomously movable home cleaning robot according to claim 1 wherein the dusting assembly comprises a dusting pad removably mounting a dusting cloth for supporting the dusting cloth against the surface to be cleaned and mounted to the base housing for movement away from the base housing for service of the dusting cloth.

3. An autonomously movable home cleaning robot according to claim 2 wherein the dusting pad is removably mounted to the base housing.

4. An autonomously movable home cleaning robot according to claim 2 wherein the dusting pad is hinged to the base housing for selectively pivoting the dusting pad between a first, opened position away from the underside of the base housing for removal and mounting of the dusting cloth to the dusting pad and a second, closed position in operative position with the base housing.

5. An autonomously movable home cleaning robot according to claim 2 and further comprising at least one dusting cloth engagement member mounted to an upper surface of the dusting pad for retaining a first portion of the dusting cloth.

6. An autonomously movable home cleaning robot according to claim 5 and further comprising at least one second dusting cloth engagement member mounted to an upper portion of the base housing for retaining a second portion of the dusting cloth, whereby the dusting cloth is positioned over a second, lower pad surface to remove dust from the surface as the base housing is maneuvered over the surface.

7. An autonomously movable home cleaning robot according to claim 6 wherein the dusting pad is at least partially resilient.

8. An autonomously movable home cleaning robot according to claim 6 wherein there are at least two second cloth engagement members.

9. An autonomously movable home cleaning robot according to claim 5 wherein there are at least two first cloth engagement members.

10. An autonomously movable home cleaning robot according to claim 1 wherein the dust bin is removably mounted to the base housing.

11. An autonomously movable home cleaning robot according to claim 10 wherein the dust bin is removable from the bottom of the base housing.

12. An autonomously movable home cleaning robot according to claim 10 wherein the dust bin is removed from the top of the base housing.

* * * * *